US010829980B2

(12) United States Patent
Jaskiewicz

(10) Patent No.: US 10,829,980 B2
(45) Date of Patent: Nov. 10, 2020

(54) ASTRAGAL AND SEALING FOR THE SAME

(71) Applicant: Endura Products, Inc., Colfax, NC (US)

(72) Inventor: Tomasz Jaskiewicz, Winston-Salem, NC (US)

(73) Assignee: Endura Products, LLC, Colfax, NC (US)

( * ) Notice: Subject to any disclaimer, the term of this patent is extended or adjusted under 35 U.S.C. 154(b) by 1038 days.

(21) Appl. No.: 15/146,286

(22) Filed: May 4, 2016

(65) Prior Publication Data

US 2017/0321470 A1 Nov. 9, 2017

(51) Int. Cl.

| | |
|---|---|
| ***E06B 3/36*** | (2006.01) |
| ***E05C 7/04*** | (2006.01) |
| ***E06B 7/16*** | (2006.01) |
| ***E06B 7/22*** | (2006.01) |
| *E06B 3/70* | (2006.01) |

(52) U.S. Cl.

CPC ..... *E06B 3/365* (2013.01); *E05C 7/045* (2013.01); *E06B 7/16* (2013.01); *E06B 7/22* (2013.01); *E06B 2003/7046* (2013.01)

(58) Field of Classification Search

CPC ..... E06B 3/365; E06B 2003/7046

USPC .... 49/365, 366, 368, 394; 52/207, 211, 301, 52/717.01; D8/400

See application file for complete search history.

(56) References Cited

U.S. PATENT DOCUMENTS

| | | | | |
|---|---|---|---|---|
| 1,368,531 A * | 2/1921 | Yauch | E04D 3/08 52/543 |
| D273,090 S * | 3/1984 | Imperial | D25/48.3 |
| 4,999,961 A * | 3/1991 | McNary | E04F 19/024 52/287.1 |
| 5,857,291 A | 1/1999 | Headrick | |
| 5,927,031 A * | 7/1999 | Martin | E04F 19/028 24/297 |

(Continued)

FOREIGN PATENT DOCUMENTS

| | | | |
|---|---|---|---|
| CA | 2342941 A1 * | 1/2001 | E05C 1/04 |
| CA | 2455696 A1 * | 7/2004 | E06B 3/365 |

(Continued)

OTHER PUBLICATIONS

Endura Products, detailed photos of prior art as shown in the Ultimate Astragal Family catalog, Jan. 19, 2015, 3 pgs.

(Continued)

*Primary Examiner* — Robert Canfield

(74) *Attorney, Agent, or Firm* — Womble Bond Dickinson (US) LLP

(57) ABSTRACT

An astragal is described having a housing and a weather-strip extending along a length of the housing. An end cap is mounted to the housing. The end cap has a bottom wall positioned substantially horizontally along the bottom end of the housing. The bottom wall has an interior edge, an exterior edge opposite the interior edge, an upper surface, and a lower surface opposite the upper surface. At least one projection extends upwardly from the upper surface at a location along the upper surface closer to the interior edge than the exterior edge. The projection sized and positioned to project into the weather-strip and at least partially seal with a cavity opening at a lower end of the weather-strip.

20 Claims, 12 Drawing Sheets

(56) References Cited

U.S. PATENT DOCUMENTS

| | | | | |
|---|---|---|---|---|
| 6,219,971 | B1 * | 4/2001 | Headrick | E06B 1/70 49/469 |
| 6,491,326 | B1 | 12/2002 | Massey et al. | |
| 6,637,158 | B2 * | 10/2003 | Bennett | E06B 1/524 49/471 |
| 7,694,471 | B2 * | 4/2010 | Meeks | E05C 1/02 49/467 |
| 7,735,882 | B2 * | 6/2010 | Abdollahzadeh | E05C 7/04 292/44 |
| 7,905,058 | B2 * | 3/2011 | Massey | E05C 7/04 49/365 |
| 8,157,298 | B2 * | 4/2012 | Mitchell | E05C 7/04 292/197 |
| 8,157,299 | B2 | 4/2012 | Mitchell et al. | |
| 9,097,043 | B2 * | 8/2015 | Mitchell | E05C 7/04 |
| D775,942 | S * | 1/2017 | Chapman | D8/330 |
| 9,624,716 | B2 * | 4/2017 | Mitchell | E06B 7/2305 |
| 2004/0256858 | A1 * | 12/2004 | Governale | E05C 1/06 292/1 |
| 2005/0120630 | A1 * | 6/2005 | Sanders | E06B 3/365 49/365 |
| 2005/0193784 | A1 * | 9/2005 | Sanders | E06B 3/365 70/106 |
| 2006/0150517 | A1 * | 7/2006 | Meeks | E05C 1/04 49/368 |
| 2007/0079557 | A1 * | 4/2007 | Pepper | E06B 3/365 49/367 |
| 2010/0212375 | A1 * | 8/2010 | Mitchell | E05B 63/242 70/141 |
| 2018/0087311 | A1 * | 3/2018 | Kendall | E05C 7/045 |
| 2018/0100346 | A1 * | 4/2018 | Kendall | E06B 3/365 |
| 2019/0211601 | A1 * | 7/2019 | Nau | E05D 15/165 |

FOREIGN PATENT DOCUMENTS

| | | | | |
|---|---|---|---|---|
| CA | 2693833 | | 4/2013 | |
| CA | 2998775 | A1 * | 11/2017 | E06B 3/32 |
| CA | 2937472 | | 5/2018 | |

OTHER PUBLICATIONS

Endura Products Ultimate Astragal Family catalog, Jan. 19, 2015, 5 pgs.

Canadian Examiner's Report for CA 2998775 dated Feb. 27, 2019, 3 pgs.

* cited by examiner

ASTRAGAL AND SEALING FOR THE SAME

FIELD OF THE INVENTION

The present disclosure generally relates to entryways, and more particularly relates to French door entryways that have an astragal attached to, and selectively securing, an inactive door.

BACKGROUND

Exterior entryways of modern homes and buildings often include cooperating pairs of swinging doors commonly referred to as double doors or French doors. As seen in FIG. 1, such entryways 10 include an inactive door 12, and an adjacent active door 14. The sets of doors may swing inwardly (as shown in FIG. 1) into the structure (so-called "inswing" doors), or may swing outwardly from the structure (so-called "outswing" doors). The inactive door 12 typically includes an astragal 16 mounted along the entire extent of a non-hinged vertical edge (stile) of the inactive door. As used herein, the term "astragal" generally means an elongated member attached to and substantially coextensive with the non-hinged vertical edge of one of a pair of swinging double doors. In a conventional arrangement, the astragal 16 is mounted along the non-hinged vertical edge of the inactive door 12, and provides a stop against which the cooperating active door 14 strikes when both doors are closed.

The astragal 16 may be provided with hardware 18, such as sliding bolts, adjacent to a top and bottom of the astragal for securing the inactive door 12 in the closed position. The hardware 18 typically engages a header 20 spanning the top of the entryway 10 and also engages a threshold 22 (also referred to as a door sill) spanning the bottom of the entryway.

Designers continuously seek to improve an entryway's ability to reduce infiltration of moisture and air. The bottom of the entryway 10 is often the most susceptible to undesired infiltration. In French door entryways 10, the number of challenges may be more numerous because of the presence of two hinged doors 12, 14 and the additional moving parts within the astragal 16, such as the hardware 18, which all combine over the threshold 22. All of these components meet at the bottom of the entryway 10 where moisture from rain gathers as it is driven against the entryway and cascades down the face of the doors 12, 14. Pressure caused by the wind drives the moisture against the intersection of these components. Accordingly, there is a need for sealing components that restrict penetration by wind driven moisture and air in the region adjacent to the bottom of the astragal.

SUMMARY

The present disclosure describes improvements to the ability to seal a French door unit against penetrating moisture and air. In a first embodiment, an improved end cap is configured for use at the lower end of an astragal. In a second embodiment, an improved gasket is configured for use on a lower bolt sleeve within the astragal. In a third embodiment, a French door unit comprises an astragal with one or both of the improved end cap and the improved gasket.

In some embodiments, an astragal is described having a housing and a weather-strip extending along a length of the housing. An end cap is mounted to the housing. The end cap has a bottom wall positioned substantially horizontally along the bottom end of the housing. The bottom wall has an interior edge, an exterior edge opposite the interior edge, an upper surface, and a lower surface opposite the upper surface. At least one projection extends upwardly from the upper surface at a location along the upper surface closer to the interior edge than the exterior edge. The projection sized and positioned to project into the weather-strip and at least partially seal with a cavity opening at a lower end of the weather-strip. The astragal may optionally include a bolt sleeve configured to translate from a retracted position within the housing to an extended position at least partially protruding from a bottom end of the housing. The astragal may also optionally include a shoot bolt configured to pass through the bolt sleeve and translate from an unlocked position within the housing to a locked position at least partially extending below a bottom surface of the bolt sleeve. A gasket may be attached to the bottom surface of the bolt sleeve.

Some embodiments of the present disclosure include an end cap for use on a bottom end of an astragal. The end cap comprises a bottom wall configured to be positioned substantially horizontally along the bottom end of the astragal, the bottom wall having an interior edge, an exterior edge opposite the interior edge, an upper surface and a lower surface opposite the upper surface. The end cap also includes at least one projection extending upwardly from the upper surface at a location along the upper surface that is closer to the interior edge than the exterior edge. The projection is sized and configured to project into a weather-strip and at least partially seal with a cavity opening at a lower end of the weather-strip.

Other embodiments of the present disclosure include a gasket for sealing a retractable bolt sleeve of an astragal to a door sill. The gasket comprises a body of resilient material having an interior edge, an exterior edge opposite the interior edge, a front edge extending substantially between the interior edge and the exterior edge, and a back edge opposite the front edge, the body having an upper surface and a lower surface. A bore, located substantially centrally within the body, passes through a thickness of the body. A slit is formed in at least one of the interior edge and the exterior edge. The slit extends toward the bore. The slit is configured to allow the gasket to be at least partially retracted within the astragal.

DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 1:
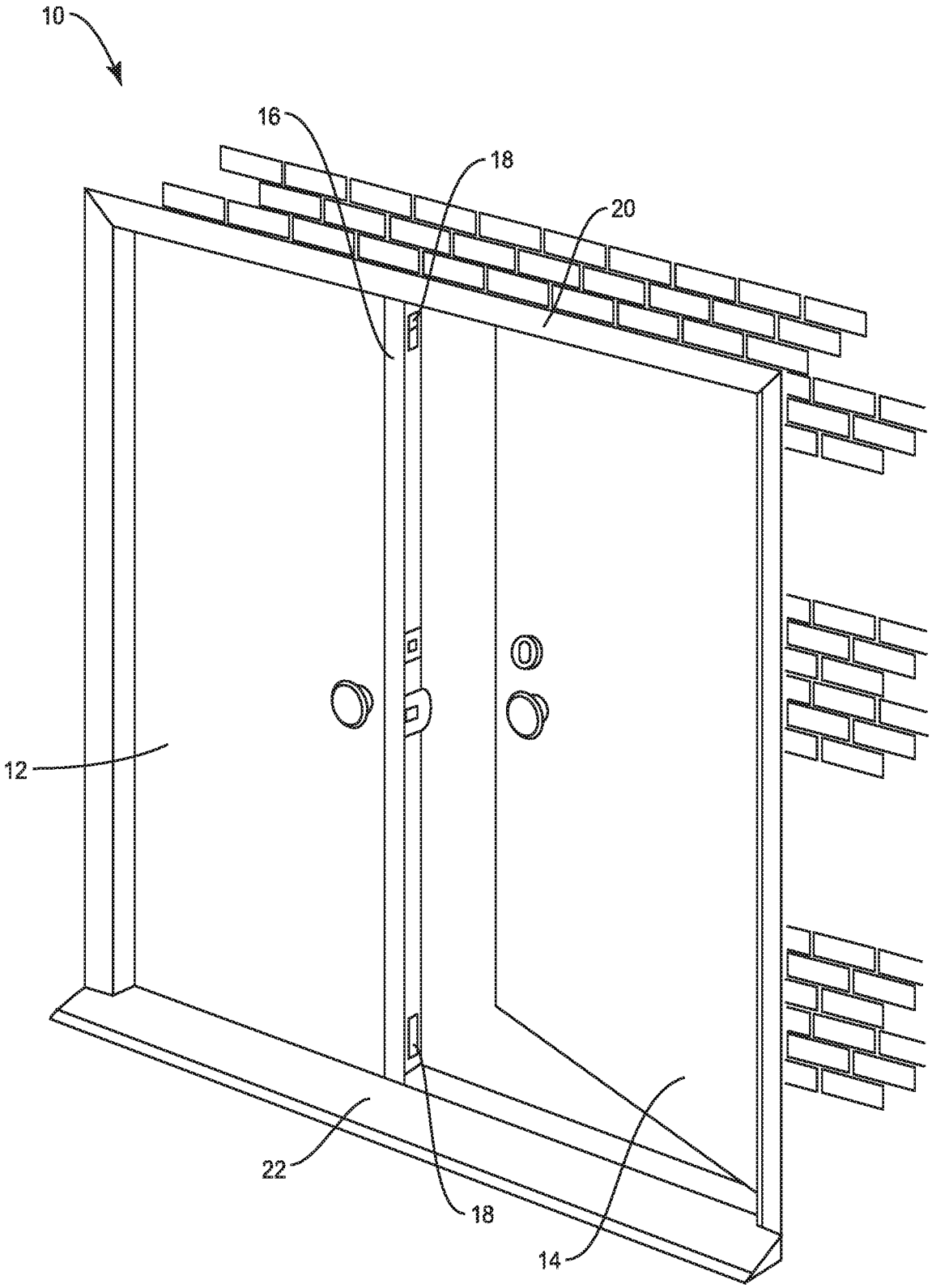
FIG. 1 PRIOR ART
FIG. 1 is an elevation view of a typical French door entryway.
Figure 2:
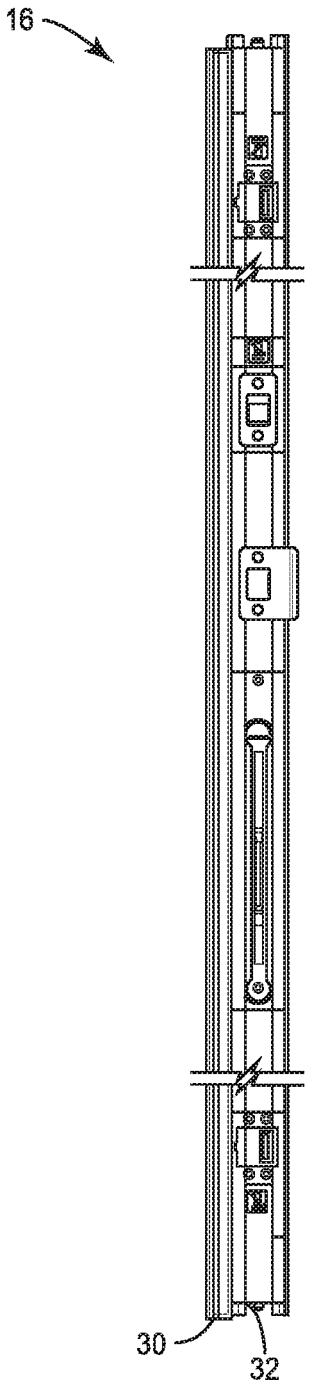
FIG. 2 is an elevation view of one embodiment of an astragal according to the present disclosure.
Figure 3:
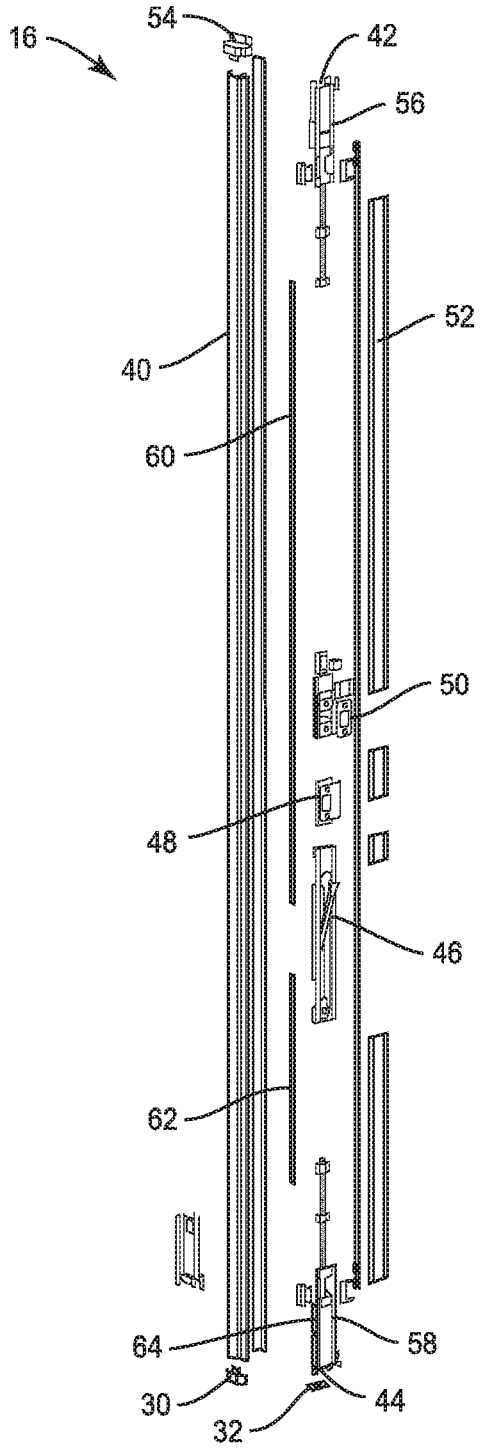
FIG. 3 is an exploded view of the astragal shown in FIG. 2.

The present disclosure describes components and functions that enhance the ability to seal a French door unit, such as an entryway 10 (FIG. 1), against penetrating moisture and air. Particularly, the present disclosure describes components and functions that enhance the ability for an astragal 16 to restrict penetration of moisture or air near the bottom thereof. According to some embodiments, one such component providing enhanced functionality is an end cap 30 mounted to the bottom of the astragal 16 as seen in FIGS. 2 and 3. According to other embodiments, a gasket 32 with improved features is disposed at the bottom of the astragal 16 to contact the threshold 22 (shown in FIG. 5). Astragals 16 of the present disclosure may include one or both of the end cap 30 and the gasket 32 to provide enhanced sealing against wind-blown moisture and air near the bottom of the astragal.

To begin, as seen in FIGS. 2 and 3, the structure and operation of an astragal 16 suitable for use with the end cap 30 and/or the gasket 32 of the present disclosure is now described. The following discussion of the astragal 16 is provided to enhance understanding of one possible embodiment of astragal components, and should not be considered limiting of the scope of the present disclosure. As shown in FIG. 3, the astragal 16 can include a housing 40. The housing 40 may be formed from metal or polymer by an extrusion process, resulting in a substantially uniform profile along the length of the housing. The housing 40 is thus provided as an elongated member configured to substantially extend the full height of a corresponding inactive door 12 (shown in FIG. 1). The housing 40 may house an upper shoot bolt 42 disposed at an upper end of the housing and a lower shoot bolt 44 disposed at a lower end of the housing. A shoot bolt actuator 46 may be provided for selectively extending and retracting the shoot bolts 42, 44. In the embodiment shown in the drawings, the shoot bolt actuator 46 is a lever-type actuator of a type known in the art. A strike plate 48 may be positioned along the astragal 16 to receive a door knob latch bolt from a cooperating active door 14, as shown in FIG. 1. The astragal 16 can also include a dead bolt plate 50 for receiving a deadbolt from a cooperating active door 14. A plurality of trim plates 52 can be provided between the various components. The astragal 16 may or may not be configured for use with a multi-point locking system.

Additional optional details of the astragal 16 can be seen in the exploded view shown in FIG. 3. An upper trim cap 54 can be provided on the upper end of the housing 40. The end cap 30 can be provided on the lower end of the housing 40 opposite the upper trim cap 54. The upper trim cap 54 may be configured to include one or more of the improvements of the end cap 30, or may include a conventional configuration.

As shown in FIG. 3, the upper shoot bolt 42 can be disposed within an upper shoot bolt assembly 56. Similarly, the lower shoot bolt 44 can be disposed within a lower shoot bolt assembly 58. The upper and lower shoot bolt assemblies 56, 58 can be respectively connected to the shoot bolt actuator 46 by upper and lower shoot bolt actuator links 60, 62. In one embodiment of the lower shoot bolt assembly 58, the lower shoot bolt 44 can be fixedly or slidably received in a bolt sleeve 64 having opposed grooves 66, as seen in FIG. 6. The opposed grooves 66 can each receive a projection 68 formed as part of the housing 40 to position the bolt sleeve 64 relative to the housing and allow the bolt sleeve to selectively slide axially along the housing. The gasket 32 is attached, by adhesive for example, to a bottom of the bolt sleeve 64 (shown in FIG. 5).

Figure 4:
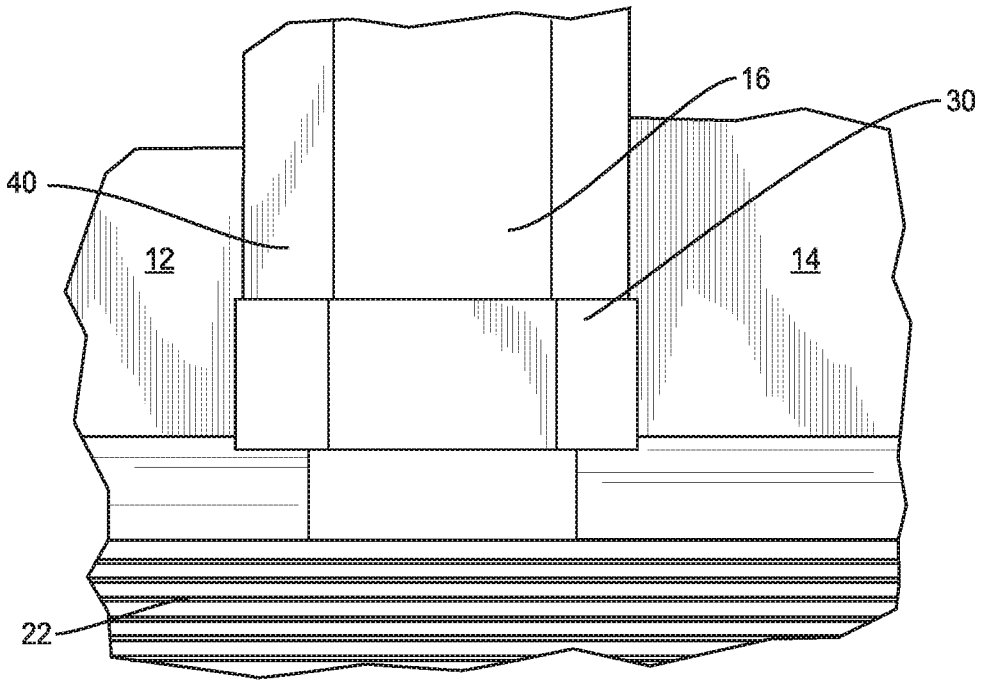
FIG. 4 is detailed view of the astragal in an unlocked position.

FIG. 4 shows an unlocked position of the astragal 16. In the unlocked position, at least the bolt sleeve (not shown) is retracted upward into the housing 40 of the astragal. Use of the shoot bolt actuator 46 (shown in FIG. 3) is then operable to switch the astragal 16 into a locked position illustrated in FIG. 5. In the locked position, at least a portion of the lower shoot bolt assembly 58, such as a portion of the bolt sleeve 64, is forced to extend at least partially outwardly from a bottom end of the housing 40. In some embodiments, the upper and lower shoot bolt assemblies may extend slightly from the ends of the housing 40 in the unlocked position as well. Therefore, the locked position would be understood as having lower shoot bolt assembly 58 more extended from the bottom end of the housing 40.

Figure 5:
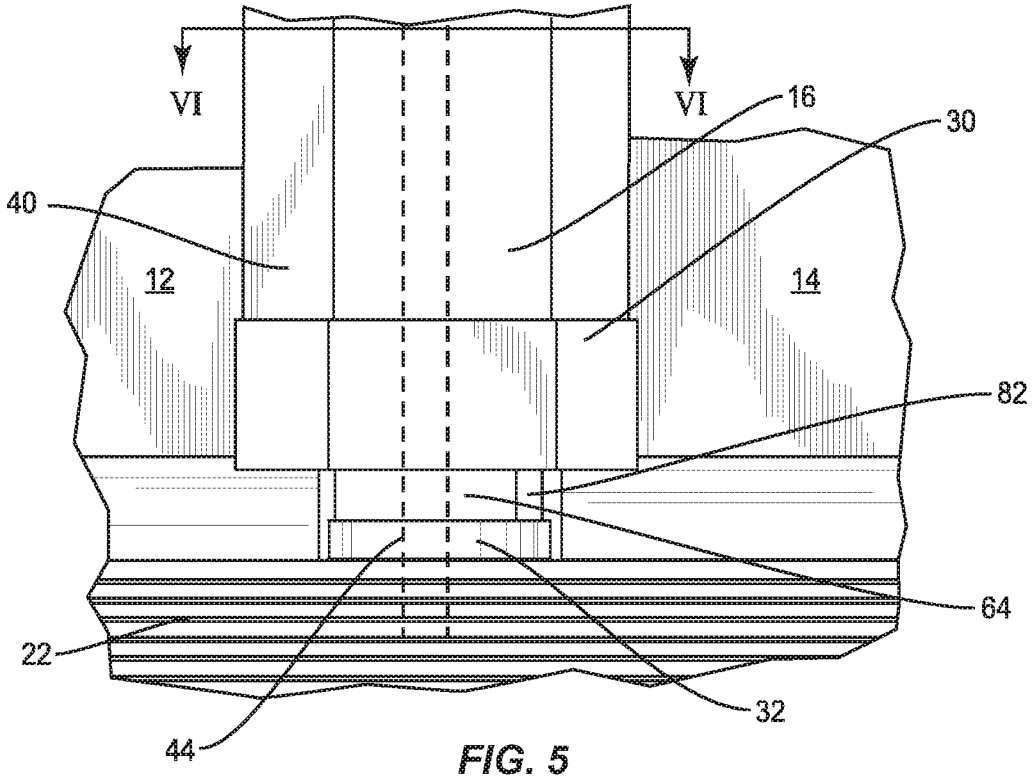
FIG. 5 is detailed view of the astragal in a locked position.
Figure 6:
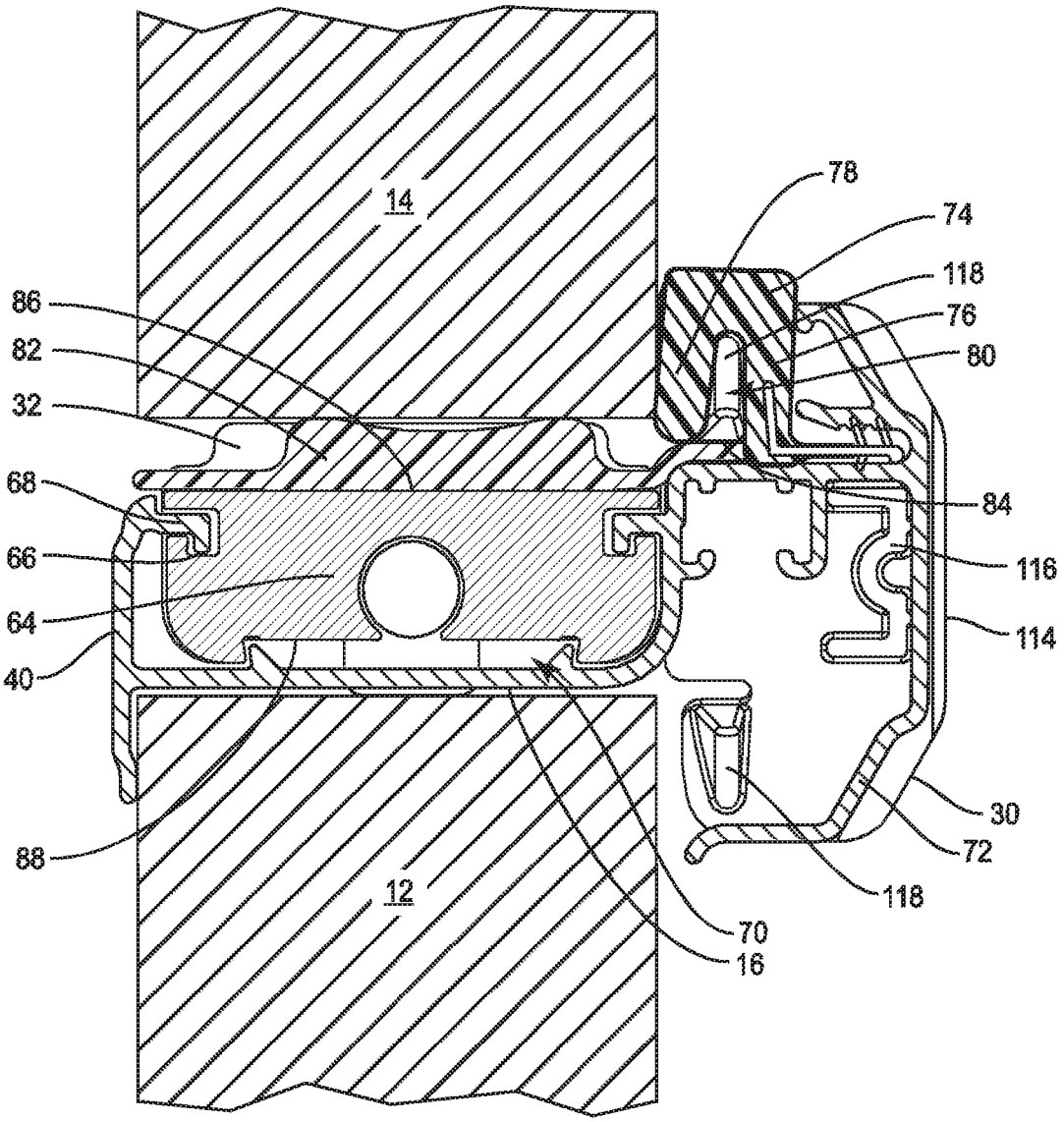
FIG. 6 is a cross sectional view of the astragal shown in FIG. 5 taken at line VI-VI and viewed from the top.

To secure the inactive door 12, the astragal 16 is used in the locked position as seen in FIG. 5. The bolt sleeve 64 extends from the housing 40 by a first magnitude. The lower shoot bolt 44 passes through the bolt sleeve 64 and extends outward relative to the bottom of the housing 40 by a second, greater magnitude. The lower shoot bolt 44 is therefore able to engage at least a portion of the threshold 22.

FIG. 6 shows a cross-sectional profile of one embodiment of the astragal 16 having the housing 40. The housing 40 can be configured for attachment along a non-hinged vertical edge of the inactive door 12. The housing 40 provides a first channel 70 along one side thereof, defined in part by the projections 68, for slidably receiving the bolt sleeve 64. An outwardly extending edge portion 72 of the housing 40 provides a stop for a cooperating active door 14. A weather-strip 74 can be attached along the edge portion 72 to provide a seal between the astragal 16 and the active door 14. The weather-strip 74 may be described as having a base 76 and a sealing portion 78 flexibly cantilevered from the base 76. The gap between the base 76 and the sealing portion 78 forms a cavity 80 that may extend along the height of the astragal 16. The end cap 30 is seen in FIG. 6 attached to the lower end of the housing 40.

Figure 7:
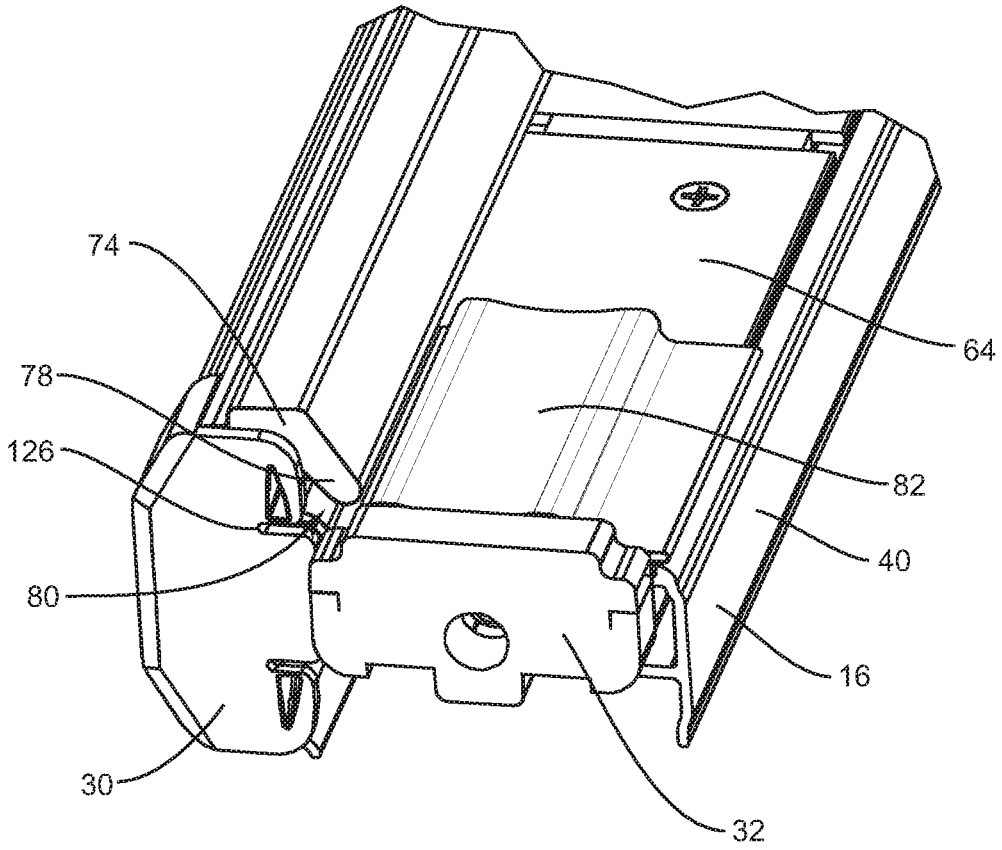
FIG. 7 is a bottom elevation view of the astragal of FIG. 4 in a retracted position.
Figure 8:
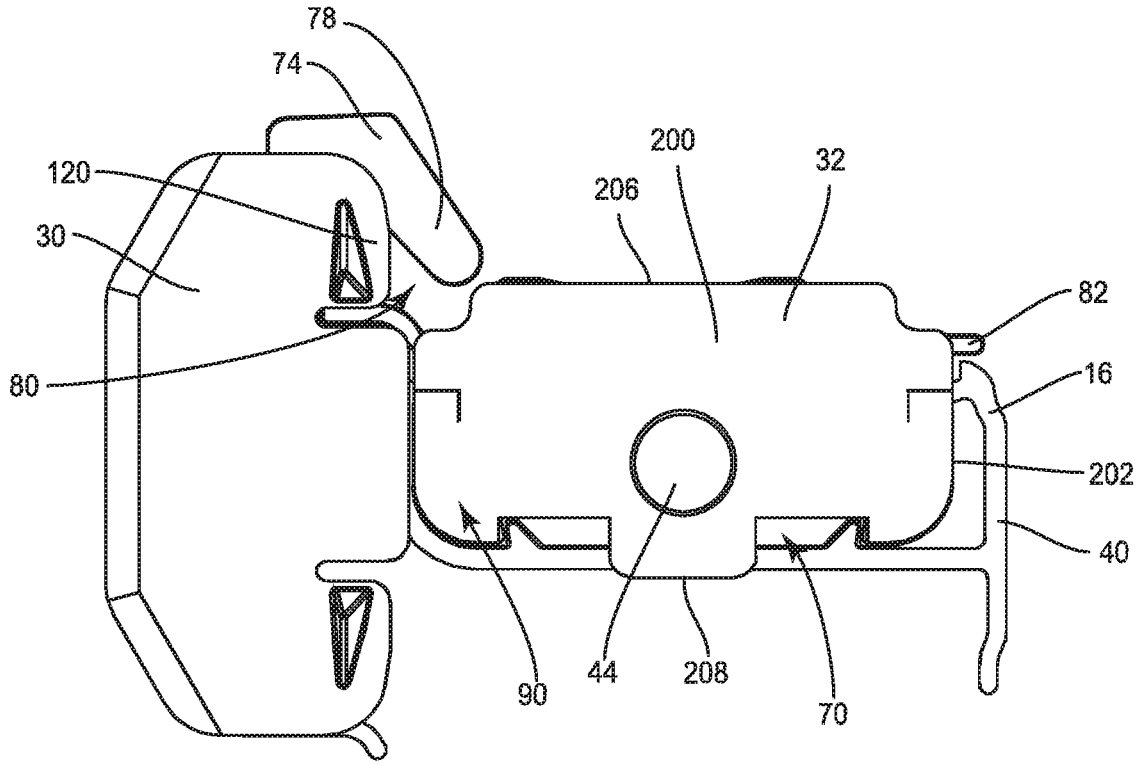
FIG. 8 is an end view of the astragal shown in FIG. 7 in a retracted position.

FIGS. 7 and 8 show a detailed bottom elevation and a detailed bottom plan view of the astragal 16 respectively. The astragal 16 is seen with the housing 40, the weather-strip 74, the end cap 30 and the gasket 32. A corner pad 82 may be joined to a side of the bolt sleeve 64 to translate therewith. An example corner pad 82 may include flanges 84 configured to help align the corner pad 82 with the bolt sleeve 64.

Returning to the improvements of the present disclosure, the astragal 16 of the present disclosure is characterized by the use of one or both of the end cap 30 and the gasket 32, each of which have been designed with improved sealing capabilities. The end cap 30 is particularly configured to mitigate wind-blown moisture or air from being pushed vertically (e.g. percolating) upward along the cavity 80 created by the weather-strip 74. Put another way, the end cap 30 is configured to close off and substantially seal a bottom entrance into the cavity 80.

FIGS. 9A-9F show several views of the end cap 30. The end cap 30 may be described as having a bottom wall 100 configured to be positioned substantially horizontally along the lower or bottom end of the astragal 16 (FIG. 7). The bottom wall 100 may include an interior edge 102 and an exterior edge 104. The exterior edge 104 is opposite the interior edge 102. A front edge 106 of the bottom wall 100 may substantially extend from the interior edge 102 to the exterior edge 104. A back edge 108, opposite the front edge 106, may similarly extend substantially from the interior edge 102 to the exterior edge 104. The terms "interior" and "exterior" are defined relative to an entryway 10 (FIG. 1) and the interior and exterior of the building. The "front" may be defined relative to the exposed side of the astragal 16, e.g. the portion facing the active door 14 (FIG. 6). The "back" may be defined relative to the hidden portion of the astragal 16, e.g. the portion of the astragal mounted to the inactive door 12 (FIG. 6). The edges of the end cap 30 are described in terms applicable to an end cap 30 for use on an astragal 16 configured for use with in-swing doors 12, 14 (FIG. 6). Embodiments where the end cap 30 is used in connection with outswing doors are also contemplated. One of ordinary skill in the art would understand that the relative terms interior and exterior may be reversed for outside door units without deviating from the scope of the present disclosure. The relative terms "front" and "back" may also be reversed depending on whether the end cap 30 is being applied to a right hand or a left hand entryway 10 (FIG. 1).

The bottom wall 100 of the end cap 30 also includes an upper surface 110 and a lower surface 112. The lower surface 112 may be opposite to and parallel with the upper surface 110. The end cap 30 is primarily for use on the bottom end of the astragal 16, but some embodiments are contemplated where the end cap 30 may be used at the upper end of the astragal. The terms "upper surface" and "lower surface" are defined based upon intended use of the end cap 30 at the lower end of the astragal 16 (FIG. 3), but one of ordinary skill in the art would understand that these relative terms could vary if the end cap 30 were used at the upper end of the astragal.

The bottom wall 100 may support an outside wall 114 projecting upwardly from the upper surface 110 of the bottom wall. The outside wall 114 is configured to be positioned along an exterior of the housing 40. The bottom wall 100 may also support an attachment projection 116 extending from the upper surface 110. The attachment projection 116 is configured to be within the housing 40 (FIG. 6) and allow the end cap 30 to be removably friction fit onto an end, such as the lower distal end, of the astragal 16.

Figure 9A:
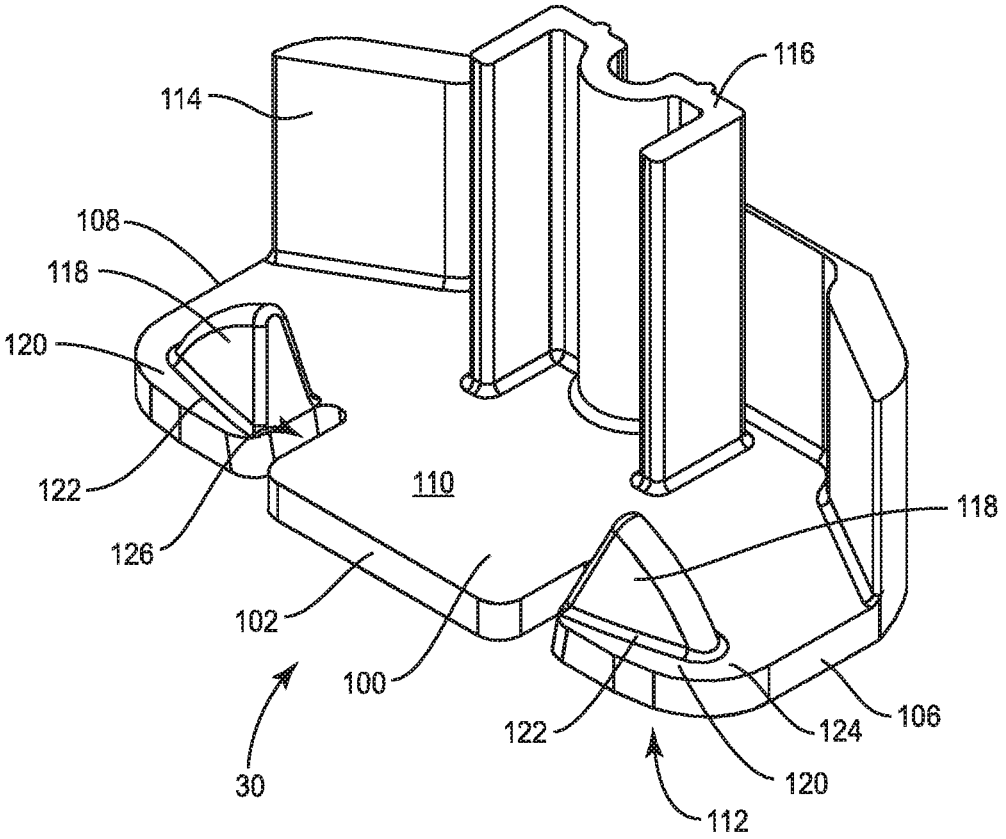
FIGS. 9A-F are perspective, top, bottom, interior, exterior and side views of the end cap respectively for the astragal of FIG. 7 according to embodiments of the present disclosure.

As seen in FIGS. 6 and 9A, the end cap 30 also includes at least one sealing plug 118 also extending upwardly from the upper surface 110 of the bottom wall 100. The at least one sealing plug 118 is configured to extend into a lower end of the cavity 80 between the base 76 and the sealing portion 78 of the weather-strip 74. The at least one sealing plug 118 assists with preventing moisture or air traveling upward within the cavity 80. The at least one sealing plug 118 may be described as at least one projection extending upwardly from the upper surface 110 at a location along the upper surface closer to the interior edge 102 than the exterior edge 104. The at least one sealing plug 118 is sized and configured to project into the weather-strip 74 attached to the housing 40 of the astragal 16.

As seen at least in FIG. 9A, a lip 120 is formed by the bottom wall 100 at least partially around a lower periphery of the at least one sealing plug 118. The lip 120 may result from the at least one sealing plug 118 being spaced from at least one of the interior edge 102 and the front edge 106 of the bottom wall 100. Thus, the portion of the bottom wall 100 between the sealing plug 118 and the respective interior and front edges 102, 106 form respective first and second lip portions 122, 124. As seen in FIG. 8, the lip 120 further assists with preventing wind driven moisture from entering a bottom of the cavity 80 by covering at least a portion of the bottom end of the weather-strip 74.

Figure 9B:
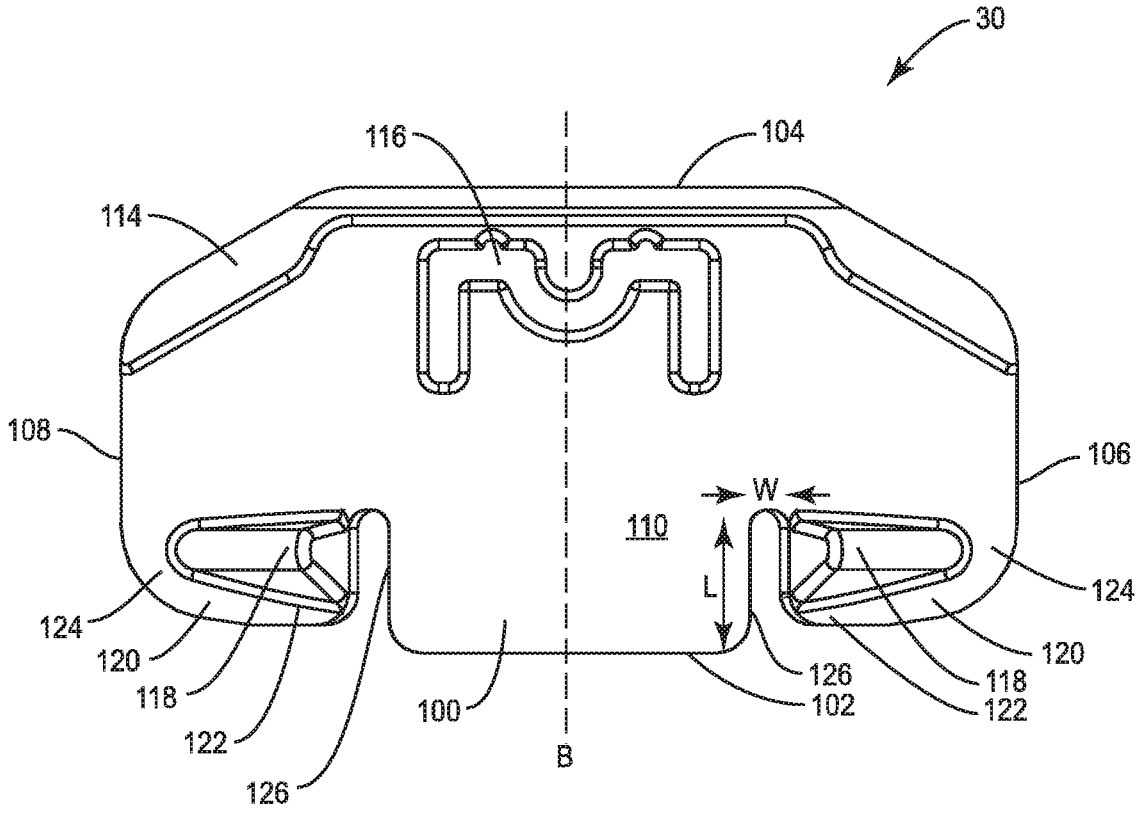
Figure 9C:
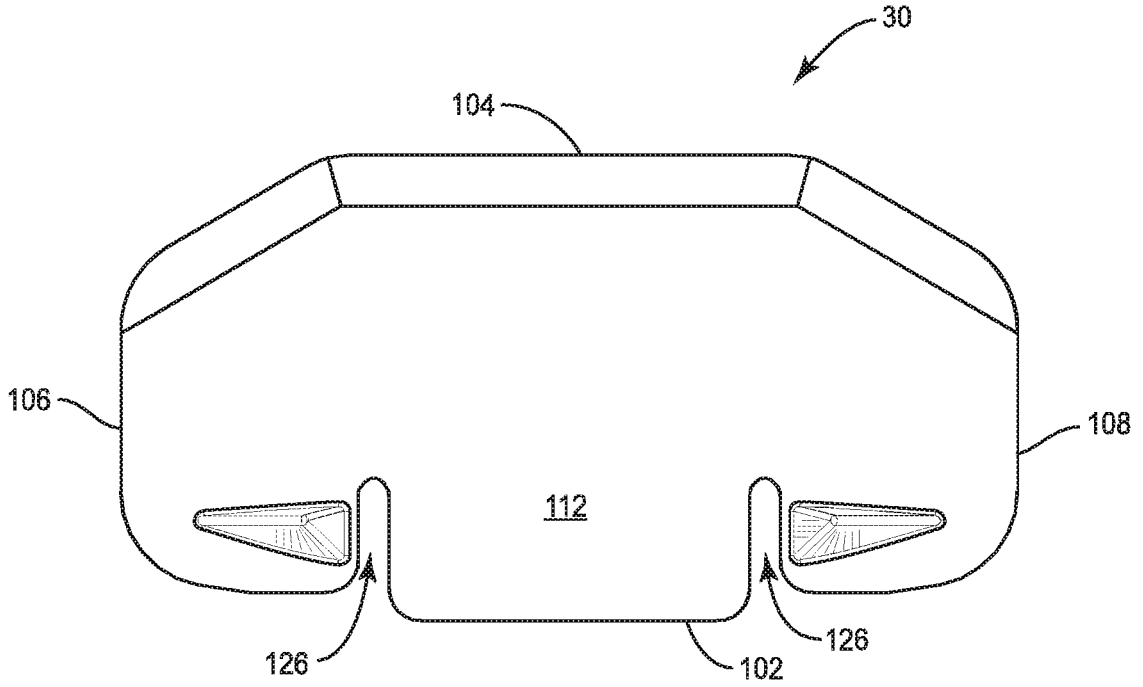
Figure 9D:
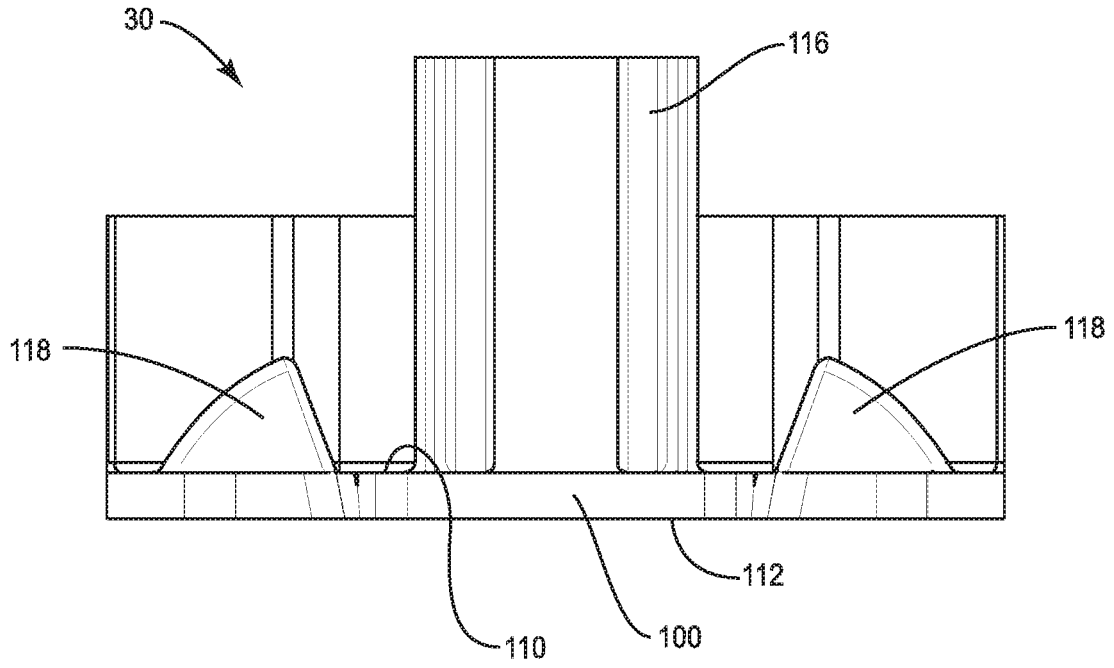
Figure 9E:
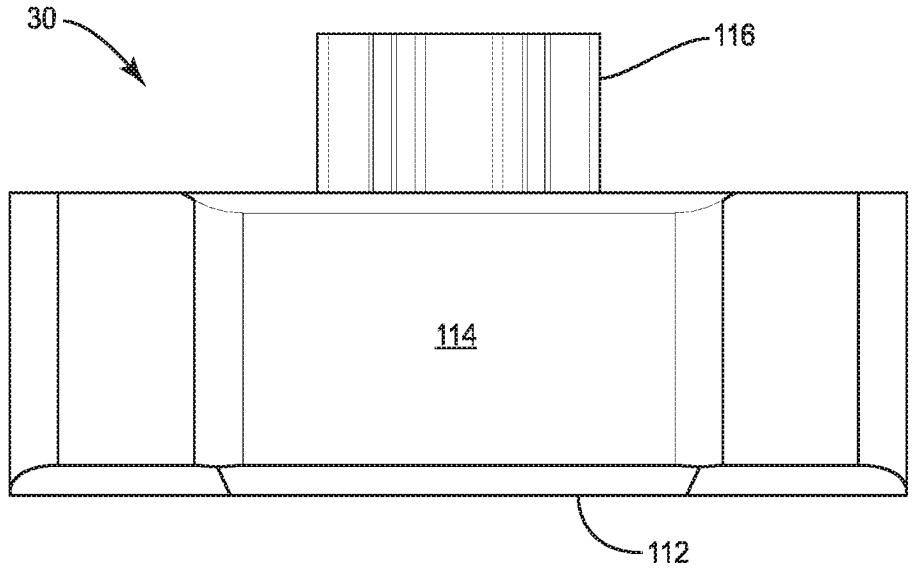
Figure 9F:
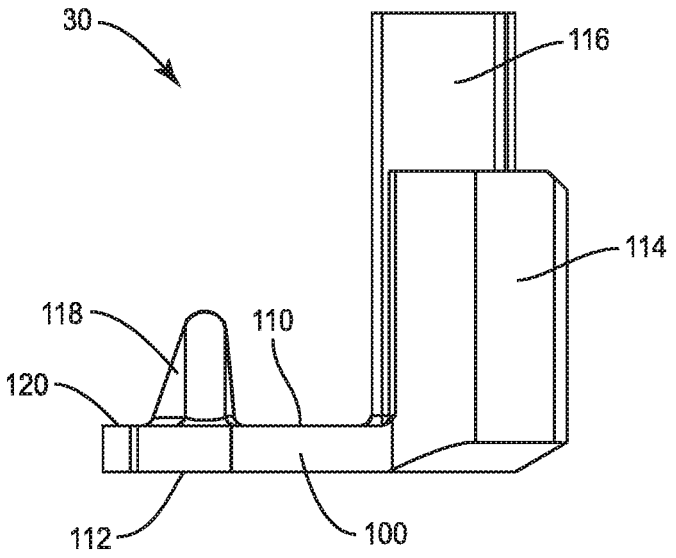

As seen in FIG. 9B, the bottom wall 100 of the end cap 30 may include at least one slot 126 extending from the interior edge 102. The at least one slot 126 may have a length L measured from the interior edge 102, and a width W measured across the slot, configured to be sufficient to provide clearance for a portion of the corner pad 82, such as the flange 84 (FIG. 6). Thus, the at least one slot 126 allows passage of the corner pad 82 through the slot as the bolt sleeve 64 extends and retracts relative to the housing 40 as the astragal 16 transitions between the locked and unlocked positions.

As seen in FIG. 9B, in one embodiment, the end cap 30 is mirror symmetric about a bisector plane B extending through the interior edge 102 and the exterior edge 104. The mirror symmetry of the end cap 30 results in the presence of a pair of sealing plugs 118. As seen in FIG. 8, only one of the sealing plugs 118 may be engaged with a weather-strip 74 for a given finished astragal 16. The mirror symmetry also results in the presence of a pair of slots 126. Only one of the slots 126 would correspond with a corner pad 82 in a given finished astragal 16. The symmetry of the end cap 30 eases assembly of the astragal 16 and minimizes the quantity of unique components, while allowing the end cap to be usable with astragals used in entryways 10 regardless of whether the inactive door 12 is on the right or the left.

An end cap 30, and an astragal 16 improved by the presence of the end cap according to embodiments of the present disclosure, may be described in terms of the following paragraphs:

Paragraph 1. An end cap for use with a lower end of an astragal, the end cap comprising:

a bottom wall configured to be positioned substantially horizontally along the lower end of the astragal, the bottom wall having an interior edge, an exterior edge opposite the interior edge, an upper surface, and a lower surface opposite the upper surface; and at least one projection extending upwardly from the upper surface at a location along the upper surface that is closer to the interior edge than the exterior edge, the at least one projection sized and configured to project into a weather-strip attached to the astragal.

Paragraph 2. The end cap of Paragraph 1, wherein the at least one projection is spaced from the interior edge of the bottom wall, and a portion of the bottom wall between the at least one projection and the interior edge forms a first portion of a lip configured to minimize water infiltration vertically along the weather-strip.

Paragraph 3. The end cap of Paragraph 2, wherein the bottom wall further comprises a front edge extending substantially between the interior edge and the exterior edge, and a back edge opposite the front edge;

wherein the at least one projection is spaced from the front edge of the bottom wall, and a portion of the bottom wall between the projection and the front edge forms a second portion of the lip to minimize water infiltration vertically along the weather-strip.

Paragraph 4. The end cap of Paragraph 1, wherein the bottom wall comprises at least one slot extending inwardly from the interior edge of the bottom wall, the at least one slot having a length and width configured to be sufficient to allow passage of a portion of a corner pad attached to the astragal.

Paragraph 5. The end cap of Paragraph 1, wherein the end cap is mirror symmetric about at least one plane.

Paragraph 6. An astragal, comprising:

a housing;

a weather-strip extending along a length of the housing;

a corner pad positioned adjacent to a bottom end of the housing; and an end cap according to Paragraph 1 installed at least partially into a bottom end of the housing such that the at least one projection of the end cap projects into and at least partially seals with a cavity having an opening at a bottom end of the weather-strip.

Paragraph 7. The astragal of Paragraph 6, further comprising:

a bolt sleeve having a retracted position within the housing and an extended position at least partially projecting from the bottom end of the housing, wherein the corner pad is attached to and translates with the bolt sleeve.

Paragraph 8. The astragal of Paragraph 7, wherein the bottom wall of the end cap comprises at least one slot extending inwardly from the interior edge, the at least one slot having a length and width allowing passage of a portion of the corner pad when the bolt sleeve is in the extended position.

Paragraph 9. A French door entryway, comprising:

an active door;

an inactive door; and an astragal according to Paragraph 6 on the inactive door.

Paragraph 10. An astragal end cap, comprising:

a bottom wall having an upper surface and a lower surface;

a first projection extending from the upper surface configured to be along an exterior of a housing of an astragal;

a second projection extending from the upper surface configured to be within the housing; and a third projection extending from the upper surface configured to be within a cavity of a weather-strip positioned along the housing.

Turning focus to FIGS. 10A-E, several views of the gasket 32 having improved features are shown. The gasket 32 may be constructed of a resilient material such as rubber, foam rubber, silicone, or similar materials known in the art. The gasket 32 may have an adhesive layer (not shown) used to attach the gasket to the astragal 16. Embodiments of the improved gasket 32 have an increased thickness compared to prior art gaskets used on astragals. For example, the gasket 32 may have a thickness of greater than 3/16 inches and may preferably having a thickness of greater than or equal to about 5/16 inches. By increasing the thickness of the gasket 32, the gasket becomes more compliant, allowing for an improved seal. The gasket 32 may also be made more compliant compared to previous gaskets by being made from a material of reduced durometer.

The size and shape of the gasket 32 are selected in an attempt to maximize sealing and contact area between and among the gasket 32, the housing 40 of the astragal 16, the bolt sleeve 64, and the threshold 22.

Figure 10A:
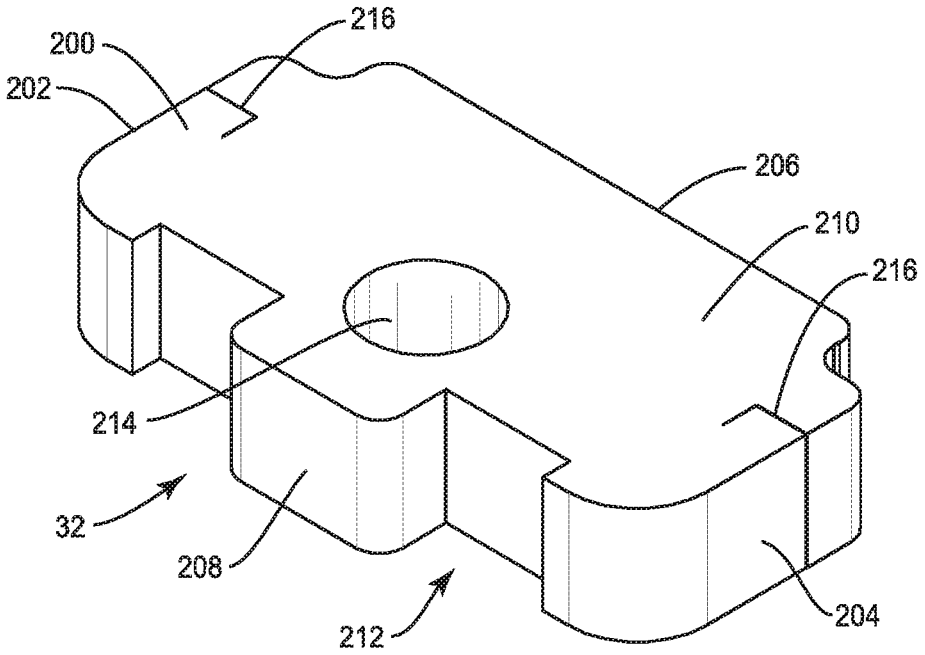
FIGS. 10A-E are perspective, bottom, back, front and side views of the gasket respectively for the astragal of FIG. 7 according to embodiments of the present disclosure.
Figure 10B:
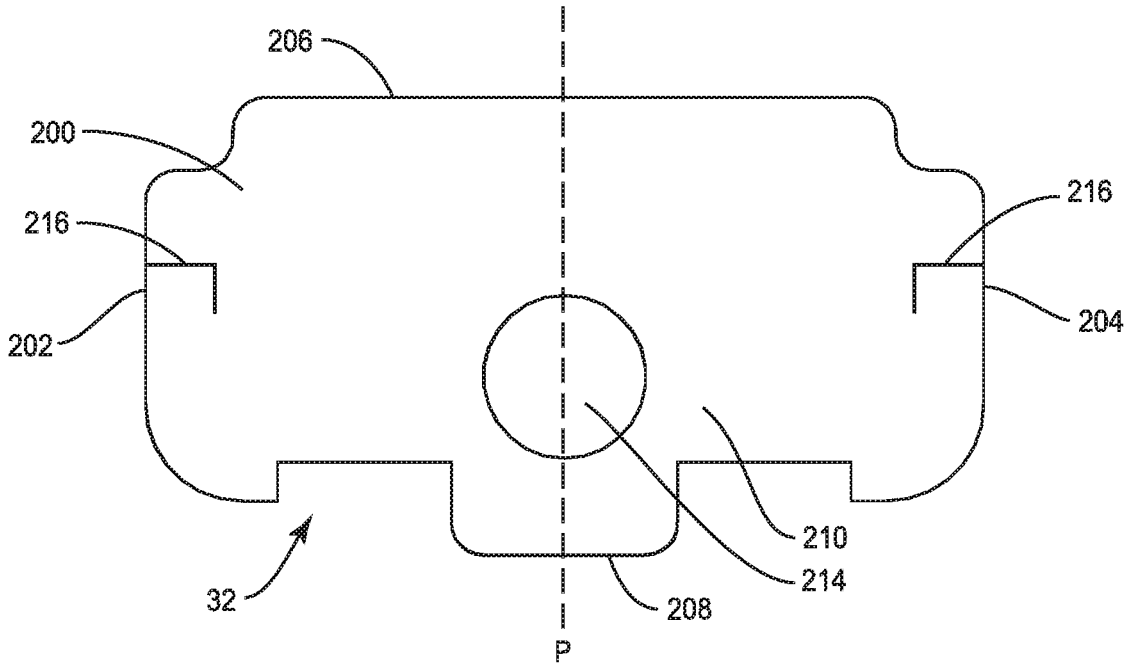
Figure 10C:
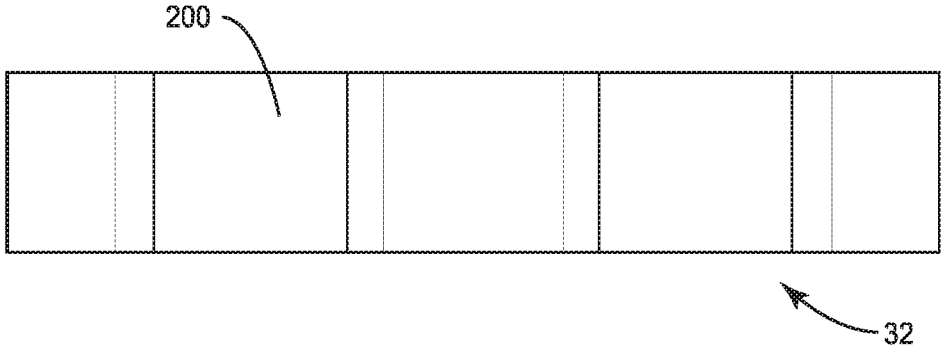
Figure 10D:
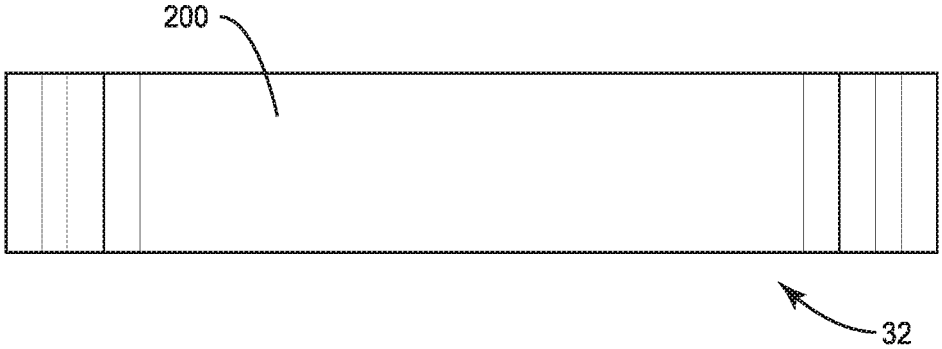
Figure 10E:
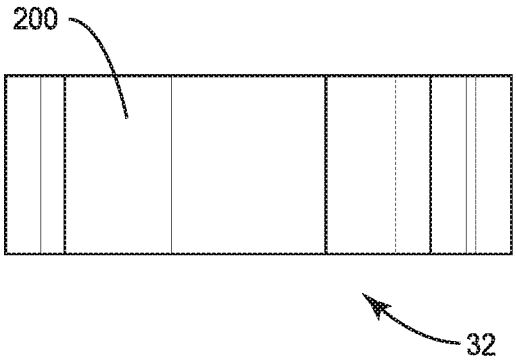

Staying with FIGS. 10A and 10B, the gasket 32 may include a body 200 of resilient material. The body 200 has an interior edge 202 and an exterior edge 204 that is opposite in the interior edge 202. A front edge 206 may extend substantially between the interior edge 202 and the exterior edge 204. A back edge 208 may be opposite the front edge 206. The back edge 208 may extend substantially between the interior edge 202 and the exterior edge 204. The body 200 may have an upper surface 210 and a lower surface 212. Similar to the end cap 30, the gasket 32 may be configured for use at the bottom end of an astragal 16 within an inswing entryway 10. The gasket 32 is configured to be attached to a lower end of the bolt sleeve 64 and is configured to slide with the bolt sleeve between the extended and retracted positions as the astragal transitions between the locked and unlocked positions respectively. The relative terms "interior," "exterior," "front," "back," "upper" and "lower" are used herein with this orientation and use of the gasket in mind, similar to the discussion above with respect to the end cap 30. One of ordinary skill in the art would appreciate that gaskets 32 according to the present disclosure could also be found at the top of astragals or as part of outswing door units, but these areas are known to be less prone to moisture infiltration. Thus it is possible in certain embodiments that the relative terms that are used in this disclosure for purposes of clarity may be reversed or changed with respect to non-illustrated embodiments.

As also seen in FIGS. 10A and 10B, the gasket 32 is likely to include a bore 214 passing through the body 200 from the upper surface 210 to the lower surface 212. The bore 214 is sized and configured to allow passage of the lower shoot bolt 44. The bore 214 may be slightly smaller in size than the bolt to allow for a compression seal between the bore and the lower shoot bolt 44 to minimize moisture from traveling up the bolt. The bore 214 may be centrally located within each of the upper and lower surfaces 210, 212. In some embodiments, the gasket 32 may be mirror symmetric about a plane P passing through the front edge 206, the bore 214 and the back edge 208, as seen in FIG. 10B.

The gasket 32 may include at least one slit 216 cut or otherwise formed into at least one of the interior edge 202 and the exterior edge 204 of the body 200. The slit 216 may have a shape, such as an L-shape, configured to generally correspond with the shape of the projections 68 (shown in FIG. 6) formed as part of the housing 40 of the astragal 16. The slit 216 is configured to allow the gasket 32 to at least partially recede into the housing 40 when the astragal 16 is in the unlocked position. The slit 216 may be replaced by other structures configured to provide similar functionality, such as open slots, or recesses formed in the body 200 that do not necessarily extend through the full thickness of the body from the upper surface 210 to the lower surface 212. The slit 216, when present, closely fits around the projection 68 to seal between the gasket 32 and the housing 40.

The shape of the upper and lower surfaces 210, 212, also referred to as the profile of the gasket 32 seen in FIG. 10B, is selected to enhance sealing by increasing contacting area between the gasket and at least one of the threshold 22, the housing 40, and the bolt sleeve 64. For example, the profile of the gasket 32 may be larger than a corresponding profile of the bolt sleeve 64. As such, the gasket 32 may extend past a front edge 86 of the bolt sleeve 64, and the gasket may extend past a back edge 88 of the bolt sleeve when the gasket is mounted to the lower end of the bolt sleeve with the bore 214 aligned with the lower shoot bolt 44. This can be seen in FIGS. 6 and 7.

At least one of the edges 202, 204, 206, 208 of the body 200 of the gasket 32 may be shaped and configured to correspond with the profile of at least a portion of the channel 70 of the housing 40, as shown in FIG. 8 at element 90. When the gasket 32 is mounted to the bolt sleeve 64 such that the lower shoot bolt 44 is aligned with the bore 214, at least a portion of the gasket may extend beyond the corresponding periphery of the bolt sleeve such that the gasket will compress against at least a portion of the housing 40 when the bolt sleeve is retracted.

The gasket 32 and an astragal 16 having the gasket may be described by the following paragraphs:

Paragraph 11. A gasket for sealing a retractable bolt sleeve of an astragal to a door sill, the gasket comprising:

a body of resilient material having an interior edge, an exterior edge opposite the interior edge, a front edge extending substantially between the interior edge and the exterior edge, and a back edge opposite the front edge, the body having an upper surface and a lower surface;

a bore passing through the thickness of the body and substantially centrally located within the body;

a slit formed in at least one of the interior edge and the exterior edge and extending toward the bore, the slit configured to allow the gasket to be at least partially retracted within the astragal.

Paragraph 12. The gasket of Paragraph 11, wherein the body is symmetric about a line of symmetry extending from the front edge to the back edge.

Paragraph 13. The gasket of Paragraph 11, wherein the body has a thickness of more than 3/16 inches.

Paragraph 14. An astragal comprising:

a housing;

a weather-strip extending along a length of the housing;

a bolt sleeve configured to slide from a retracted position within the housing to an extended position at least partially protruding from a bottom end of the housing; and a gasket according to Paragraph 11 attached to a bottom end of the bolt sleeve.

Paragraph 15. The astragal of Paragraph 14, wherein a bottom profile of the gasket is larger than a bottom profile of the bolt sleeve such that the gasket extends past a front edge of the bolt sleeve and the gasket extends past a back edge of the bolt sleeve.

Paragraph 16. An astragal comprising:

a housing having at least one channel;

a bolt sleeve configured to slide from a retracted position within the housing to an extended position at least partially protruding from a bottom end of the housing, the bolt sleeve sliding within at least the at least one inner channel; and a gasket attached to a bottom surface of the bolt sleeve, the gasket having a bottom surface configured for sealing against a door sill, the gasket comprising:

a body of resilient material having an interior edge, an exterior edge opposite the interior edge, a front edge extending substantially between the interior edge and the exterior edge, and a back edge, wherein a bottom profile of the body is sized and configured to seal against the channel at least when the bolt sleeve is in the retracted position.

Paragraph 17. The astragal of Paragraph 16, wherein the body further comprises a slit formed in each of the interior edge and the exterior edge, each slit extending toward a bore passing through a center of the body, each slit configured to allow the gasket to be at least partially retracted within the housing.

The above descriptions of preferred embodiments of the invention are intended to illustrate various aspects and features of the invention without limitation. Persons of ordinary skill in the art will recognize that certain changes and modifications can be made to the described embodiments without departing from the scope of the invention. For example, while the invention has been described for use with swinging doors, a locking system according to the invention can also be applied to casement window panels and casement window frames, or the like. All such changes and modifications are intended to be within the scope of the appended claims.

The invention claimed is:

1. An end cap for use on a bottom end of an astragal, the end cap comprising:

a bottom wall configured to be positioned substantially horizontally along the bottom end of the astragal, the bottom wall having an interior edge, an exterior edge opposite the interior edge, an upper surface and a lower surface opposite the upper surface;

at least one projection extends upwardly from the upper surface at a location along the upper surface that is closer to the interior edge than the exterior edge, the projection sized and configured to project into a weather-strip and at least partially seal with a cavity opening at a lower end of the weather-strip, the at least one projection being non-symmetrical about a plane orthogonal to the upper surface and passing through a center of the at least one projection;

an outside wall extending from the upper surface, the outside wall configured to be positioned along an exterior of a housing secured to the end cap; and an attachment projection extending from the upper surface, the attachment portion configured to form a friction fit to secure the end cap to the housing.

2. The end cap of claim 1, wherein the at least one projection is spaced from the interior edge of the bottom wall, and a portion of the bottom wall between the projection and the interior edge forms a first portion of a lip configured to minimize water infiltration vertically along the weather-strip.

3. The end cap of claim 2, wherein the bottom wall further comprises a front edge substantially extending between in interior edge and the exterior edge; wherein the projection is spaced from the front edge of the bottom wall, and a portion of the bottom wall between the projection and the front edge forms a second portion of the lip to minimize water infiltration vertically along the weather-strip.

4. The end cap of claim 1, wherein the bottom wall comprises at least one slot extending inwardly from the interior edge of the bottom wall, the at least one slot having a length and width configured to be sufficient to allow passage of a portion of a corner pad associated with the astragal.

5. The end cap of claim 1, wherein the end cap is mirror symmetric about at least one plane.

6. The end cap of claim 1, wherein the interior edge defines an innermost extremity of the bottom wall and the exterior edge defines an outermost extremity of the bottom wall.

7. An astragal comprising:

a housing having a longitudinal axis;

a extending along a length of the housing; and an end cap attached to the housing, the endcap comprising:

a first wall having an interior edge and an exterior edge opposite the interior edge, the first wall having a first surface and a second surface opposite the first surface, the second surface configured to face a weather strip such that a longitudinal axis of the weather strip is orthogonal to the second surface; and a first projection extending away from the second surface adjacent the interior edge, the projection configured to form at least a partial seal with an opening defined in an end of the weather strip, the first projection being non-symmetrical about a plane orthogonal to the second surface and passing through a center of the first projection.

8. The astragal of claim 7, wherein the first projection is spaced from the interior edge of the first wall such that a first portion of a lip of the first wall is defined between the first projection and the interior edge, the lip configured to minimize water infiltration in a direction perpendicular to the longitudinal axis of the weather-strip.

9. The astragal of claim 8, wherein the first wall includes a front edge extending between the interior edge and the exterior edge, the first projection spaced from the front edge of the first wall such that a second portion of the lip is defined between the first projection and the front edge.

10. The astragal of claim 7, wherein the end cap further comprises a second projection extending away from the second surface adjacent the exterior edge, the second projection configured to frictionally engage a housing to attach the end cap thereto.

11. The astragal of claim 7, wherein the end cap further comprises a second wall extending orthogonally away from the second surface along the exterior edge of the first wall.

12. An astragal comprising:

a housing;

a weather-strip extending along a length of the housing;

a bolt sleeve configured to translate from a retracted position within the housing to an extended position at least partially protruding from a bottom end of the housing;

a shoot bolt configured to pass through the bolt sleeve and translate from an unlocked position within the housing to a locked position at least partially extending below a bottom surface of the bolt sleeve; and an end cap mounted to the housing, comprising:

a bottom wall positioned substantially horizontally along the bottom end of the housing, the bottom wall having an interior edge, an exterior edge opposite the interior edge, an upper surface, and a lower surface opposite the upper surface, the bottom wall comprising at least one slot extending inwardly from the interior edge, the at least one slot having a length and width configured to be sufficient to allow passage of a portion of a corner pad attached to the bolt sleeve; and at least one projection extending upwardly from the upper surface at a location along the upper surface closer to the interior edge than the exterior edge, the at least one projection projecting into the weather-strip and at least partially sealing with a cavity opening at a lower end of the weather-strip.

13. The astragal of claim 12, further comprising a gasket attached to the bottom surface of the bolt sleeve.

14. The astragal of claim 13, wherein a bottom profile of the gasket is larger than a bottom profile of the bolt sleeve such that the gasket extends past a front edge of the bolt sleeve, and the gasket extends past a back edge of the bolt sleeve.

15. The astragal of claim 13, wherein the gasket comprises:

a body of resilient material having an interior edge, an exterior edge opposite the interior edge, a front edge extending substantially between the interior edge and the exterior edge, and a back edge opposite the front edge, the body having an upper surface and a lower surface;

a bore passing through a thickness of the body and substantially centrally located within the body; and a slit formed in at least one of the interior edge and the exterior edge, the slit extending toward the bore, the slit configured to allow the gasket to be at least partially retracted within the housing.

16. The astragal of claim 15, wherein the body is symmetric about a line of symmetry extending from the front edge to the back edge.

17. The astragal of claim 15, wherein the body has a thickness of more than 3/16 inches.

18. The astragal of claim 12, wherein the at least one projection is spaced from the interior edge of the bottom wall, and a portion of the bottom wall between the projection and the interior edge forms a first portion of a lip configured to minimize water infiltration vertically along the weather-strip.

19. The astragal of claim 18, wherein the bottom wall further comprises a front edge substantially extending between the interior edge and the exterior edge; wherein the projection is spaced from the front edge of the bottom wall, and a portion of the bottom wall between the projection and the front edge forms a second portion of the lip to minimize water infiltration vertically along the weather-strip.

20. The astragal of claim 12, wherein the end cap is mirror symmetric about at least one plane.

* * * * *